US010026541B2

(12) United States Patent
Shiota et al.

(10) Patent No.: US 10,026,541 B2
(45) Date of Patent: Jul. 17, 2018

(54) MOLDED STATIONARY INDUCTION APPARATUS AND METHOD FOR MANUFACTURING MOLDED STATIONARY INDUCTION APPARATUS

(71) Applicants: TOSHIBA INDUSTRIAL PRODUCTS AND SYSTEMS CORPORATION, Kawasaki-shi (JP); KABUSHIKI KAISHA TOSHIBA, Minato-ku (JP)

(72) Inventors: Hiromu Shiota, Mie-gun (JP); Tetsuo Nakamae, Mie-gun (JP); Yuusuke Shima, Mie-gun (JP); Teruhiko Maeda, Mie-gun (JP); Masaharu Kubota, Minato-ku (JP)

(73) Assignees: TOSHIBA INDUSTRIAL PRODUCTS AND SYSTEMS CORPORATION, Kawasaki-shi (JP); Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 15/313,451

(22) PCT Filed: Feb. 27, 2015

(86) PCT No.: PCT/JP2015/055847
§ 371 (c)(1),
(2) Date: Nov. 22, 2016

(87) PCT Pub. No.: WO2015/182199
PCT Pub. Date: Dec. 3, 2015

(65) Prior Publication Data

US 2017/0186530 A1 Jun. 29, 2017

(30) Foreign Application Priority Data

May 26, 2014 (JP) ..... 2014-108236

(51) Int. Cl.
*H01F 27/08* (2006.01)
*H01F 27/28* (2006.01)
(Continued)

(52) U.S. Cl.
CPC ..... *H01F 27/2876* (2013.01); *H01F 27/08* (2013.01); *H01F 27/29* (2013.01); *H01F 27/324* (2013.01); *H01F 41/02* (2013.01)

(58) Field of Classification Search
CPC ..... H01F 27/00–27/36
(Continued)

(56) References Cited

U.S. PATENT DOCUMENTS 2,293,453 A * 8/1942 Clark ..... F26B 21/145 34/408
2,751,562 A * 6/1956 Camilli ..... H01F 27/085 336/180
(Continued)

FOREIGN PATENT DOCUMENTS

CN 201804677 U 4/2011
GB 488980 A 7/1938
(Continued)

OTHER PUBLICATIONS

International Search Report dated Apr. 14, 2015, in PCT/JP2015/055847 filed Feb. 27, 2015.
(Continued)

*Primary Examiner* — Tuyen Nguyen
(74) *Attorney, Agent, or Firm* — Oblon, McClelland, Maier & Neustadt, L.L.P.

(57) ABSTRACT

A molded stationary induction apparatus is provided with: a winding the surface of which is covered with resin or an insulating material containing resin; a closed vessel in which the winding is housed and air having pressure exceeding
(Continued)

atmospheric pressure is sealed; and a heat exchanger which cools the air in the closed vessel.

8 Claims, 5 Drawing Sheets

(51) Int. Cl.
*H01F 27/32* (2006.01)
*H01F 41/02* (2006.01)
*H01F 27/29* (2006.01)

(58) Field of Classification Search
USPC ..... 336/55–62, 90
See application file for complete search history.

(56) References Cited

U.S. PATENT DOCUMENTS

| | | | | |
|---|---|---|---|---|
| 2,875,263 | A * | 2/1959 | Narbutovskih | F28D 15/0266 165/104.25 |
| 2,927,736 | A * | 3/1960 | Rohatyn | H01F 27/085 236/49.3 |
| 2014/0132381 | A1* | 5/2014 | Weber | H01F 27/025 336/60 |

FOREIGN PATENT DOCUMENTS

| | | | |
|---|---|---|---|
| JP | 4-354312 | A | 12/1992 |
| JP | 9-213532 | A | 8/1997 |
| JP | 10-163035 | A | 6/1998 |
| JP | 10-189348 | A | 7/1998 |
| JP | 11-135333 | A | 5/1999 |
| JP | 2001-143943 | | 5/2001 |
| JP | 2003-17332 | A | 1/2003 |
| JP | 2003-142318 | A | 5/2003 |
| JP | 2004-336892 | A | 11/2004 |
| JP | 2013-171947 | A | 9/2013 |

OTHER PUBLICATIONS

Extended European Search Report dated Jan. 3, 2018 in Patent Application No. 15799757.8.
Combined Chinese Office Action and Search Report dated Oct. 23, 2017 in Chinese Patent Application No. 201580027105.9 (with English translation of Category of Cited Documents), citing documents AO through AR therein, 8 pages.
Office Action dated Jan. 9, 2018 in Japanese Application No. 2014-108236 filed May 26, 2014.

* cited by examiner

MOLDED STATIONARY INDUCTION APPARATUS AND METHOD FOR MANUFACTURING MOLDED STATIONARY INDUCTION APPARATUS

TECHNICAL FIELD

Embodiments of the present invention relate to a molded stationary induction apparatus and a method of manufacturing the same.

BACKGROUND ART

A transformer, which is a stationary induction apparatus used in an electric power system or power reception and transformation is broadly divided into 1: a liquid cooled transformer that uses an insulating oil or liquid silicone, for example, 2: a gas insulated transformer whose insulation and cooling are based on inert gases such as $SF_6$, and 3: a dry type transformer in which an iron core and windings are used in air. IEC (International Electrotechnical Commission) and JEC (Japanese Electrotechnical Committee of the Institute of Electrical Engineers of Japan), for example, which are applicable standards of a transformer, define a kind of dry type transformer in which the entire surface of windings are covered with resin or an insulating material including resin, as a molded transformer.

In recent years, transformers are increasingly required to be environmentally sustainable, noncombustible, and flame-retardant. For this reason, instead of a gas insulated transformer using inert gases such as $SF_6$, which is a kind of a greenhouse gas, or a liquid cooled transformer requiring time and trouble for processing at a site, the demand for a dry type transformer is becoming higher. In particular, a molded transformer also uses a resin layer applied on windings for its insulating function, and can therefore have a higher insulating performance than other dry type transformers. Hence, molded transformers are increasingly used in particularly high-voltage fields.

However, insulation between a high-voltage winding and a low-voltage winding, and insulation between a member at a ground potential such as an iron core and a winding, are affected by air as well as the resin layer. Hence, application of conventional molded transformers have been limited to around 33 kV in Japan, and around 77 kV, except for in special cases, even in foreign countries such as Europe and the United States.

Also, since air at atmospheric pressure has higher viscosity and lower density than $SF_6$ gas, for example, there is a limit to its cooling performance. For this reason, the transformer capacity of conventional molded transformers have been limited to about 15 MVA or lower.

CITATION LIST

Patent Literature

Patent Literature 1: Japanese Patent Laid-Open No. 2003-142318

Patent Literature 2: Japanese Patent Laid-Open No. 10-189348

SUMMARY OF INVENTION

Technical Problem

Against this background, provided are a molded stationary induction apparatus applicable to higher voltage and suited for larger capacity, and a method of manufacturing the same.

Solution to Problem

A molded stationary induction apparatus of the embodiments include: a winding whose surface is covered with any of resin and an insulating material containing resin; a closed vessel that accommodates the winding, and encapsulates air having a higher pressure than atmospheric pressure; and a heat exchanger that cools the air inside the closed vessel.

DESCRIPTION OF EMBODIMENTS

Figure 1:
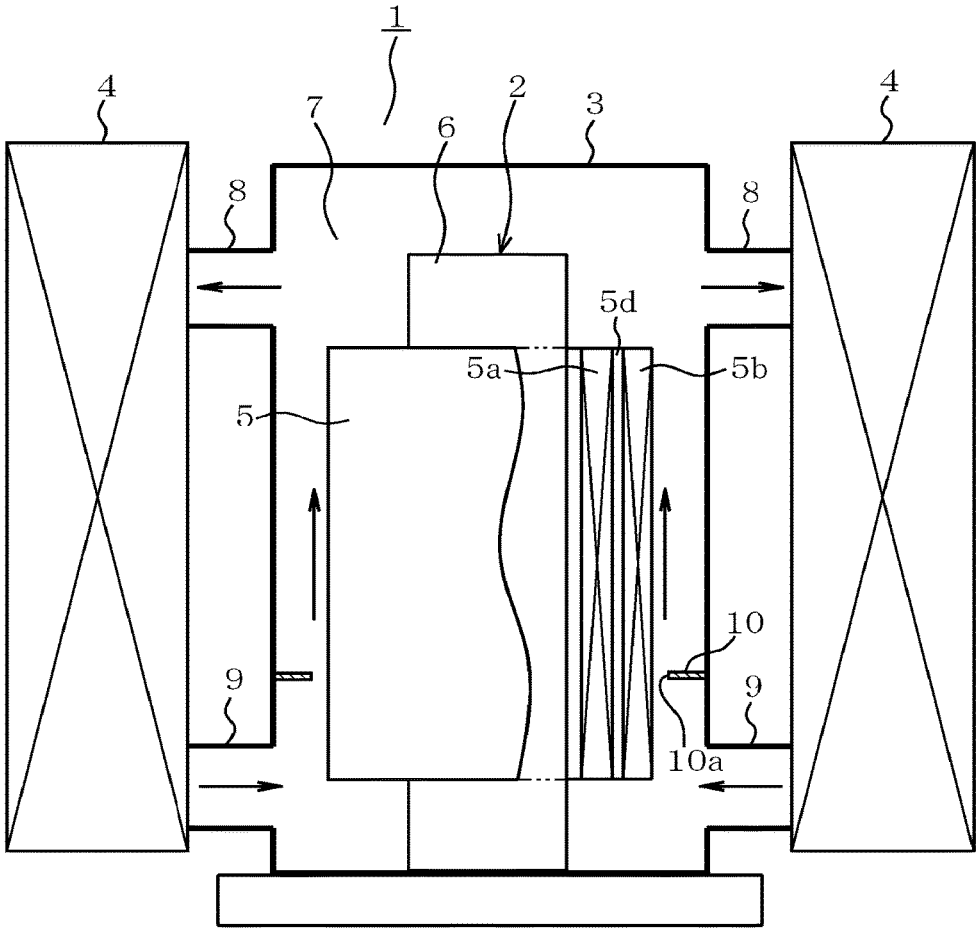
FIG. 1 is a longitudinal section view showing a schematic configuration of a molded transformer of a first embodiment.

Hereinbelow, molded stationary induction apparatuses of multiple embodiments will be described with reference to the drawings. Note that in the embodiments, substantially the same components are assigned the same reference numerals, and descriptions thereof will be omitted.

First Embodiment

Figure 2:
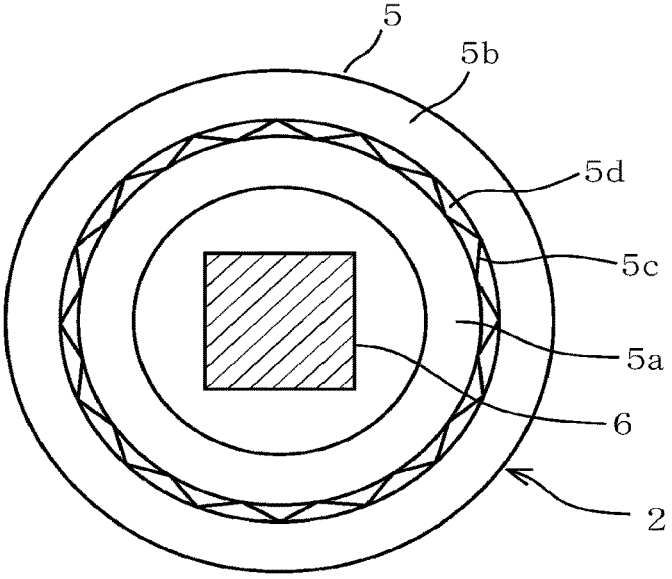
FIG. 2 is a cross-sectional view of contents of the molded transformer.
Figure 3:
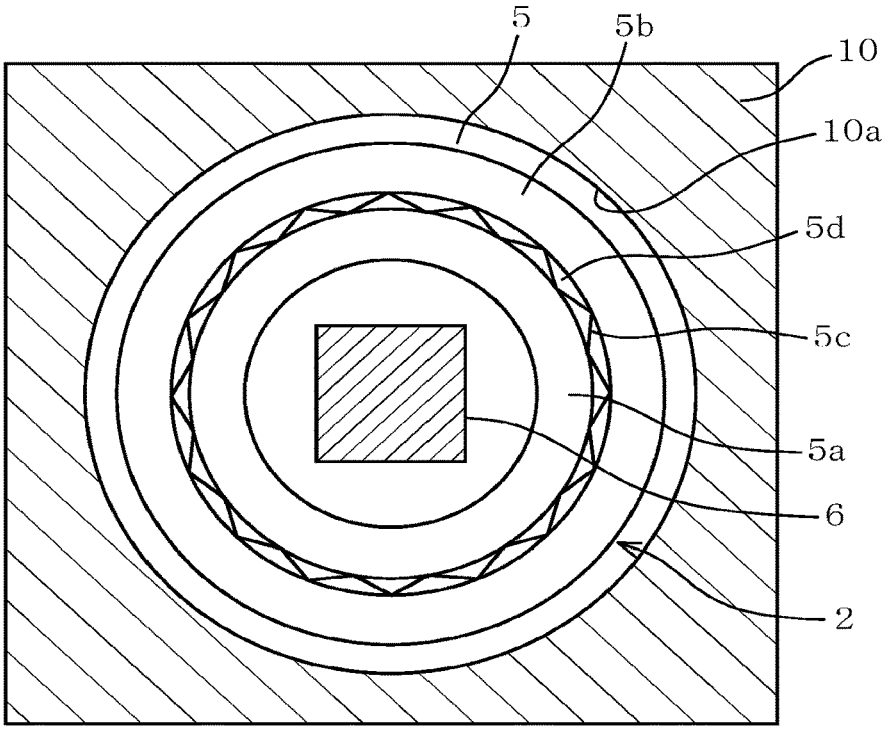
FIG. 3 is a cross-sectional view of the contents of the molded transformer and a partition plate.

First, a first embodiment will be described with reference to FIGS. 1 to 3. FIG. 1 shows a schematic configuration of a molded transformer 1, which is a molded stationary induction apparatus. The molded transformer 1 includes contents 2 of molded transformer, a closed vessel 3, and heat exchangers 4. The contents 2 of molded transformer constitute contents of the molded stationary induction apparatus. The closed vessel 3 accommodates the contents 2 of molded transformer. The heat exchangers 4 are provided on outer side surfaces (right and left in FIG. 1) of the closed vessel 3.

The contents 2 of molded transformer are configured of a combination of windings 5 and an iron core 6. Resin or an insulating material containing resin covers the surface of the windings 5. The windings 5 include a low-voltage winding 5*a* and a high-voltage winding 5*b*. The low-voltage winding 5*a* is attached to the outer periphery of the iron core 6. The high-voltage winding 5*b* is arranged on the outer periphery of the low-voltage winding 5*a*. FIG. 2 shows a cross-sectional view of the contents 2 of molded transformer. The contents 2 of molded transformer include a corrugated spacer 5*c*. The spacer 5*c* is provided between the low-voltage winding 5*a* and the high-voltage winding 5*b*. The spacer 5*c* ensures a certain gap 5*d* between the low-voltage winding 5*a* and the high-voltage winding 5*b*, and ensures a required insulating strength. Although a corrugated duct is shown as an example, the spacer 5*c* may be in any form as long as it ensures the gap 5*d*.

As shown in FIG. 1, the closed vessel 3 encapsulates air 7, while accommodating the contents 2 of molded transformer. The air 7 is air having a higher pressure than atmospheric pressure. The molded transformer 1 includes upper connection ducts 8 and lower connection ducts 9. The upper connection ducts 8 and the lower connection ducts 9 each connects the closed vessel 3 and the right and left heat exchangers 4. The upper connection ducts 8 are connected to upper parts of the closed vessel 3, and the lower connection ducts 9 are connected to lower parts of the closed vessel 3.

As shown in FIG. 1, the closed vessel 3 has a partition plate 10. The partition plate 10 is provided higher than the lower connection ducts 9 and lower than the upper connection ducts 8, inside the closed vessel 3. The partition plate 10 is fixed to an inner surface of the closed vessel 3. As shown in FIG. 3, the partition plate 10 has a flow hole 10*a*. The flow hole 10*a* is a circular hole formed along the outer peripheral part of the windings 5, and is formed in a part of the partition plate 10 adjacent to the outer peripheral part of the windings 5.

With this configuration, when the molded transformer 1 starts to operate, the contents 2 of molded transformer generate heat. Then, the heat generation by the contents 2 of molded transformer raises the temperature of the air 7 inside the closed vessel 3. As indicated by arrows in FIG. 1, the air 7 with raised temperature rises inside the closed vessel 3, flows to the heat exchangers 4 side through the upper connection ducts 8, and is cooled. Then, the air 7 cooled by the heat exchangers 4 is returned into the closed vessel 3 through the lower connection ducts 9. Thus, the air 7 inside the closed vessel 3 circulates through the heat exchangers 4. Circulation of the air 7 inside the closed vessel 3 through the heat exchangers 4 cools the air 7 inside the closed vessel 3, and therefore cools the contents 2 of molded transformer.

A part of the air 7 circulating inside the closed vessel 3 passes through a gap between the flow hole 10*a* of the partition plate 10 and the outer peripheral part of the windings 5. At this time, the air 7 passing through the gap between the flow hole 10*a* and the outer peripheral part of the windings 5 cools the windings 5 from its outer peripheral part. Since the air 7 flowing through the outer peripheral part of the windings 5 flows through a part close to the windings 5, the cooling effect can be improved. Additionally, the gap 5*d* between the low-voltage winding 5*a* and the high-voltage winding 5*b* of the windings 5 is formed by the spacer 5*c*. Hence, a part of the air 7 circulating inside the closed vessel 3 enters the gap 5*d* of the windings 5, too, and also cools the windings 5 from the inside. Thus, the effect of cooling the windings 5 can be improved even more.

Incidentally, the dielectric strength of air is substantially proportional to the absolute pressure of the air. Accordingly, air at 1 atmosphere of gauge pressure (2 atmospheres of absolute pressure) has substantially twice the dielectric strength of air at atmospheric pressure (1 atmosphere of absolute pressure). Also, the heat-carrying capacity of gas increases with increasing density. Hence, at a constant flow rate, air at 1 atmosphere of gauge pressure (2 atmospheres of absolute pressure) has twice the cooling capacity of air at atmospheric pressure (1 atmosphere of absolute pressure).

According to the molded transformer 1 of the above embodiment, the contents 2 of molded transformer are accommodated inside the closed vessel 3. Additionally, the air 7 having a higher pressure than atmospheric pressure is encapsulated inside the closed vessel 3. This can improve the dielectric voltage of the air 7 that affects insulation between the high-voltage winding 5*b* and the low-voltage winding 5*a* of the windings 5, and insulation between the member at a ground potential such as the iron core 6 and the windings 5.

In this case, the dielectric voltage is set equal to or higher than a normally used voltage (normal voltage), for the contents 2 of molded transformer alone. In addition, the overall dielectric voltage is set equal to or higher than a test voltage (e.g., power-frequency voltage or impulse voltage) specified by a standard or the like, when the contents 2 of molded transformer are accommodated inside the closed vessel 3 that encloses the air 7 having a higher pressure than atmospheric pressure. By setting the dielectric voltage in this manner, a relatively safe operation can be achieved in a stationary state, even when air is discharged from the closed vessel 3. Moreover, although in the above example the dielectric voltage is set equal to or higher than the normally used voltage for the contents 2 of molded transformer alone, the same effects can be obtained by setting the dielectric voltage equal to or higher than the normally used voltage, when the contents 2 of molded transformer are accommodated inside the closed vessel 3 that encloses the air 7 at atmospheric pressure.

Also, the molded transformer 1 includes the heat exchangers 4 for increasing the density of the air 7 inside the closed vessel 3 and cooling the air 7. Hence, the cooling capacity inside the closed vessel 3 is improved. As a result, it is possible to provide the higher-voltage and larger-capacity molded transformer 1, beyond the limits of voltage and capacity of the conventional molded transformers, whose insulation and cooling functions had been based on air at atmospheric pressure.

Additionally, after having undergone a dielectric voltage test, the molded transformer 1 of the above embodiment is shipped after replacing the air 7 inside the closed vessel 3 with new fresh air 7. In an apparatus such as the molded transformer 1 that adopts an insulating system in which the insulating function is partially based on air, standards such as the aforementioned IEC and JEC allow local and limited dielectric breakdown of air and partial discharge at the time of a lightening impulse test, for example. When a partial discharge occurs in air, ozone or a heating event resulting from the partial discharge may cause a nearby insulating material to generate an infinitesimal amount of cracked gas. In an electrical apparatus encapsulating an insulating medium in a closed vessel, the insulating medium may be extracted from inside the electrical apparatus, and gas contained in the extract may be analyzed by gas chromatography, to detect malfunction in the electrical apparatus or diagnose a degraded state of the electrical apparatus.

According to the molded transformer 1 of the embodiment, after performing a dielectric voltage test, the air 7 inside the closed vessel 3 is replaced with new fresh air 7 before shipping, as mentioned above. Hence, by performing the aforementioned analysis at the shipping destination, detection of malfunction in the apparatus and diagnosis of a degraded state can be performed more accurately.

In the embodiment, the gas encapsulated inside the closed vessel 3 is air. Hence, unlike $SF_6$ gas which is a kind of a greenhouse gas, the air can be released into the atmosphere without requiring any particular recovery work. Accordingly, work required for replacing gas (air) inside the closed vessel 3 can be made easy.

Second Embodiment

Next, a second embodiment will be described with reference to FIGS. 4 and 5. A molded transformer 11 of the second embodiment includes fans 12. The fans 12 are provided inside lower connection ducts 9. As shown in FIG. 5, the fan 12 includes multiple, such as three, fan blades 13, a fan motor 14 that rotates the fan blades 13, and a frame 15 that supports the fan motor 14.

Figure 4:
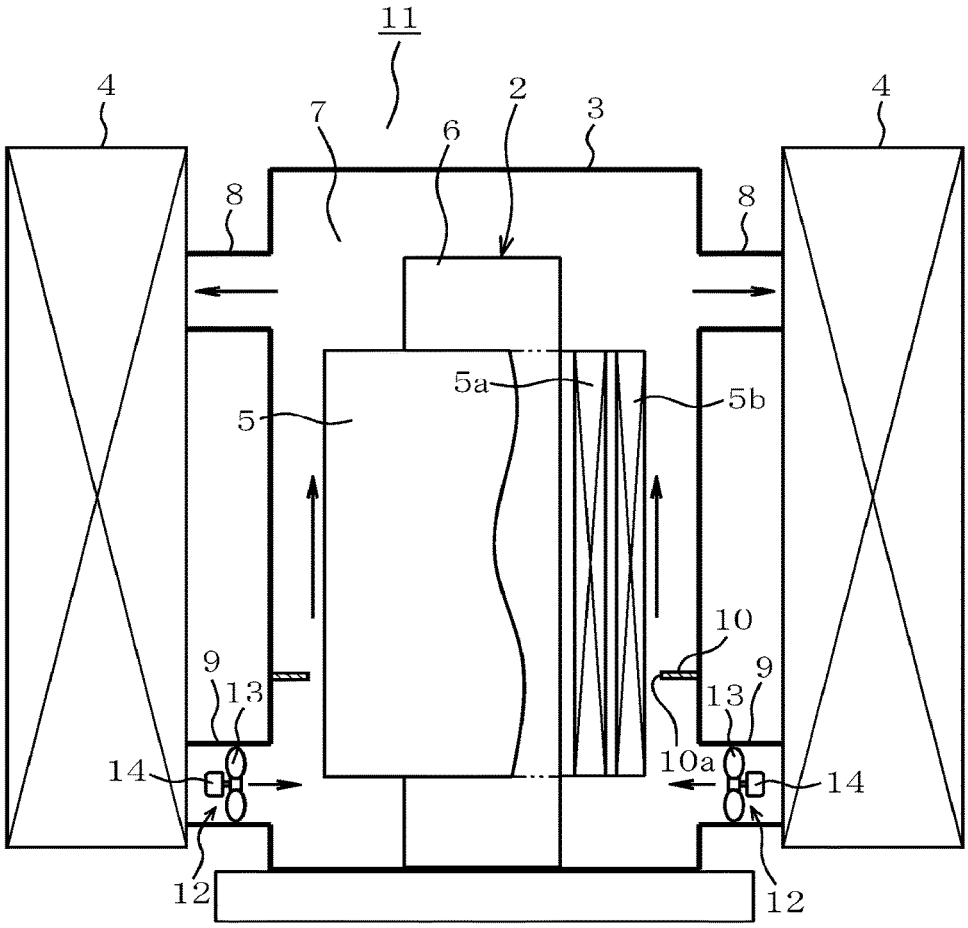
FIG. 4 is a view corresponding to FIG. 1, according to a second embodiment.
Figure 5A:
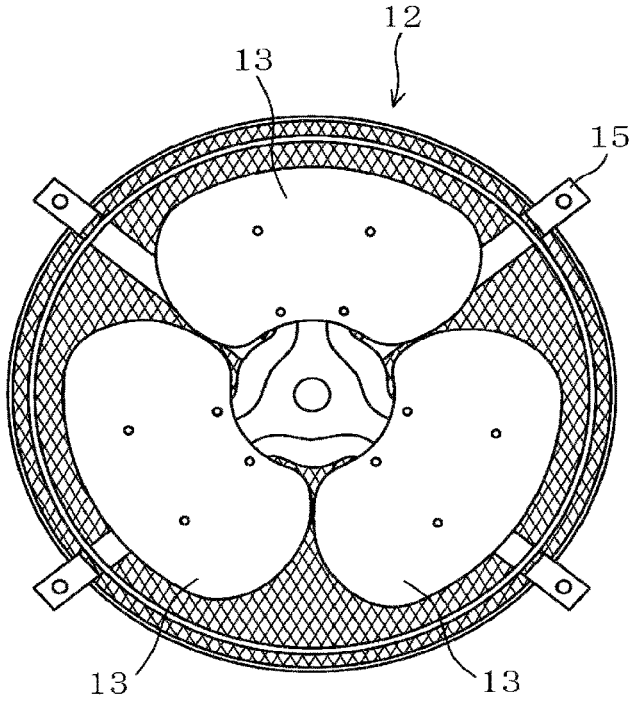
FIG. 5 shows a fan, in which FIG. 5(*a*) is a front view, and FIG. 5(*b*) is a cutaway side view.
Figure 5B:
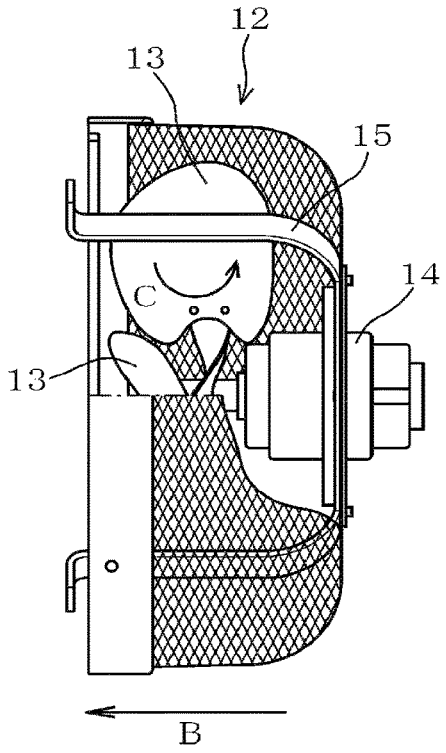

In this configuration, when the fans 12 are activated during operation of the molded transformer 11, the blast effect of the fan blades 13 forcibly circulates air 7 inside a closed vessel 3 through heat exchangers 4, in the direction of arrows in FIG. 4. This improves the flow rate of circulated air circulating inside the closed vessel 3, and increases the amount of air circulation. Then, the increase in the amount of air circulation can improve the cooling capacity of the windings 5 of contents 2 of molded transformer, and the cooling capacity of the heat exchangers 4. Moreover, by providing a partition plate 10 in this embodiment, too, as in FIG. 4, cooling efficiency can be improved even more.

In addition, in the embodiment, the direction of the fan blades 13 of the fan 12 is switchable between a blast position shown in FIG. 5, and an unillustrated flow resistance-lowered position. When the direction of the fan blades 13 is in the blast position shown in FIG. 5, each of the fan blades 13 is substantially facing the front, and is tilted slightly obliquely with respect to a blast direction (see arrow B of FIG. 5(*b*)). When the fan blades 13 rotate in this state, the fans 12 exert their blast effect and forcibly move the air inside the closed vessel 3 in the arrow direction.

In contrast, when the direction of the fan blades 13 is in the flow resistance-lowered position, each of the fan blades 13 rotates for about 90 degrees in an arrow C direction in FIG. 5(*b*) around a base end part of each fan blade 13, and becomes substantially parallel to an arrow B direction, which is the blast direction. In this case, the flow resistance of air passing through between the fan blades 13 is lower than when the fan blades 13 are substantially facing the front. Accordingly, if the fan blades 13 are switched to the flow resistance-lowered position when operation of the fan 12 is stopped, the flow resistance of air naturally flowing near the fan blades 13 inside the lower connection ducts 9 can be brought lower than when the fan blades 13 are in the blast position.

Incidentally, if the fan blades 13 are in the blast position shown in FIG. 5 when the fan 12 is in a stopped state, the flow resistance of air naturally flowing near the fan blades 13 is large, and the fan blades 13 become a factor that inhibits natural convection. Meanwhile, by switching the fan blades 13 to the aforementioned flow resistance-lowered position when the fan 12 is in the stopped state, it is possible to prevent the inhibition of natural convection by the fan blades 13 as much as possible, as mentioned earlier. Thus, it is possible to increase the flow rate of the air 7 inside the closed vessel 3 while self-cooling by natural convection, when the fan 12 is in a stopped state.

As the flow resistance-lowered position of the fan blades 13, each of the fan blades 13 may be rotated frontward or rearward around its base end part as a supporting point, such that a tip end part of the fan blade 13 collapses toward the rotation axis of the fan motor 14, which is the center of rotation of the fan blades 13. Note that the fan blades 13 are switched between the blast position and the flow resistance-lowered position, by a worker's switch operation or manual operation from outside.

In the molded transformer 11 of the second embodiment, too, after performing a dielectric voltage test, the air 7 inside the closed vessel 3 should preferably be replaced with new fresh air 7 before shipping, as in the case of the first embodiment.

Third Embodiment

Figure 6:
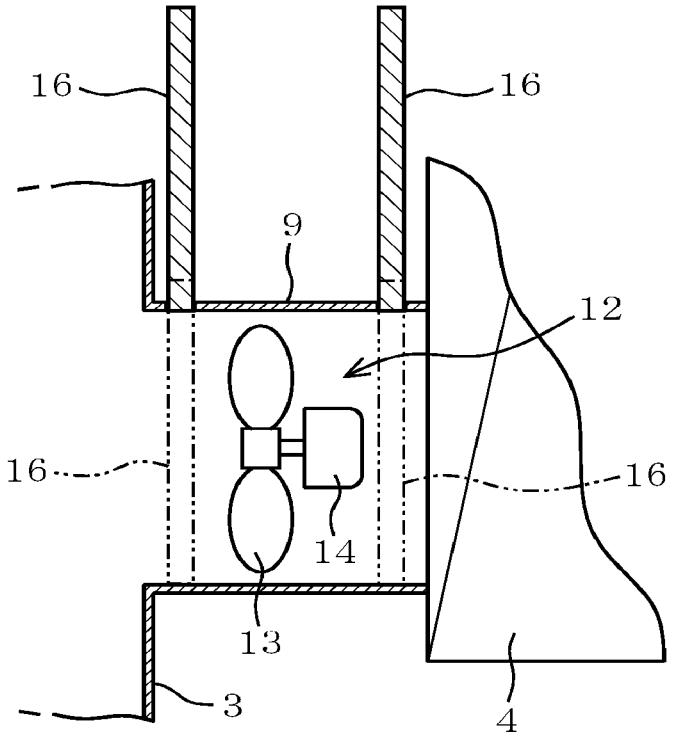
FIG. 6 is a longitudinal section view of the periphery of a fan of a third embodiment.

Next, a third embodiment will be described with reference to FIG. 6. The third embodiment is different from the second embodiment in the following point. That is, a molded transformer 11 of the third embodiment includes opening and closing members 16. The opening and closing member 16 is provided on both of the heat exchanger 4 side and the windings 5 side of a fan 12, in a lower connection duct 9 where the fan 12 is provided. The opening and closing member 16 is a vertically movable shutter, for example. The opening and closing member 16 opens the lower connection duct 9 at an opening position indicated by a solid line in FIG. 6, and allows flow of air flowing through the lower connection duct 9. On the other hand, the opening and closing member 16 closes the lower connection duct 9 at a closing position indicated by a chain double-dashed line in FIG. 6, and blocks the flow of air flowing through the lower connection duct 9.

With this configuration, if the fan 12 fails, the opening and closing members 16 may be kept in the closing position, so that the fan 12 can be replaced without leaking the air 7 inside the closed vessel 3 to the outside.

Note that although the embodiment describes an example in which the opening and closing member 16 is provided on both of the heat exchanger 4 side and the windings 5 side of the fan 12, the configuration is not limited to this. The above-mentioned effect can be achieved by providing the opening and closing member 16 at least on the windings 5 side.

Also, the opening and closing member 16 is not limited to the vertically movable shutter. The opening and closing member 16 may be a disc-like member that opens and closes the lower connection duct 9 by rotating around an axis, for example.

Other Embodiments

The molded stationary induction apparatus is not limited to a molded transformer, and may be a molded reactor.

As has been described, according to the molded stationary induction apparatus of the embodiments, it is possible to provide a molded stationary induction apparatus applicable to higher voltage and suited for larger capacity.

Although some embodiments of the present invention have been described, the embodiments have been presented as examples, and are not intended to limit the scope of the invention. These new embodiments can be implemented in various other forms, and various omissions, replacements, and changes can be made without departing from the gist of the invention. These embodiments and their modifications are included in the scope and gist of the invention, and are also included within the invention described in the scope of claims and its equivalents.

REFERENCE SIGNS LIST

In the drawings, reference numeral 1 indicates a molded transformer (molded stationary induction apparatus), reference numeral 2 indicates contents of molded transformer (contents of molded stationary induction apparatus), reference numeral 3 indicates a closed vessel, reference numeral 4 indicates a heat exchanger, reference numeral 5 indicates a winding, reference numeral 5*a* indicates a low-voltage winding, reference numeral 5*b* indicates a high-voltage winding, reference numeral 5*c* indicates a spacer, reference numeral 5*d* indicates a gap, reference numeral 6 indicates an iron core, reference numeral 7 indicates air, reference numeral 10 indicates a partition plate, reference numeral 10*a* indicates a flow hole, reference numeral 11 indicates a molded transformer (molded stationary induction apparatus), reference numeral 12 indicates a fan, reference numeral 13 indicates a fan blade, reference numeral 14 indicates a fan motor, and reference numeral 16 indicates an opening and closing member.

The invention claimed is:

1. A molded stationary induction apparatus comprising:

contents including an iron core and a winding disposed on the iron core and having a surface covered with resin or an insulating material containing resin;

a closed vessel that accommodates the contents of the molded stationary induction apparatus, and encapsulates air having a higher pressure than atmospheric pressure; and a heat exchanger that cools the air inside the closed vessel, wherein the overall dielectric voltage is set equal to or higher than a normally used voltage, when the contents of the molded stationary induction apparatus are accommodated inside the closed vessel that encloses air at atmospheric pressure.

2. The molded stationary induction apparatus according to claim 1, wherein the winding has a spacer that forms a gap between a low-voltage winding and a high-voltage winding.

3. The molded stationary induction apparatus according to claim 1, further comprising a partition plate provided between an outer peripheral part of the winding and an inner surface of the closed vessel, wherein the partition plate has a flow hole positioned adjacent to the winding, and allowing air inside the closed vessel to pass therethrough.

4. A molded stationary induction apparatus comprising:

contents including an iron core and a winding disposed on the iron core and having a surface covered with resin or an insulating material containing resin;

a closed vessel that accommodates the contents of the molded stationary induction apparatus, and encapsulates air having a higher pressure than atmospheric pressure; and a heat exchanger that cools the air inside the closed vessel, and a fan that circulates air inside the closed vessel, wherein a direction of a fan blade of the fan is switchable between a blast position that exerts a blast effect along with rotation of the fan blade when the fan is operating, and a flow resistance-lowered position that reduces flow resistance of air naturally flowing near the fan blade when the fan is stopped.

5. A manufacturing method of a molded stationary induction apparatus, wherein after having undergone a dielectric voltage test, the molded stationary induction apparatus according to claim 1 is shipped after replacing air inside the closed vessel with new fresh air.

6. A manufacturing method of a molded stationary induction apparatus, wherein after having undergone a dielectric voltage test, the molded stationary induction apparatus according to claim 2 is shipped after replacing air inside the closed vessel with new fresh air.

7. A manufacturing method of a molded stationary induction apparatus, wherein after having undergone a dielectric voltage test, the molded stationary induction apparatus according to claim 3 is shipped after replacing air inside the closed vessel with new fresh air.

8. A manufacturing method of a molded stationary induction apparatus, wherein after having undergone a dielectric voltage test, the molded stationary induction apparatus according to claim 4 is shipped after replacing air inside the closed vessel with new fresh air.

* * * * *